US008020720B2

(12) United States Patent
Duquet et al.

(10) Patent No.: US 8,020,720 B2
(45) Date of Patent: Sep. 20, 2011

(54) STOPPER MEMBER, A FLUID DISPENSER COMPRISING SUCH A MEMBER, AND A METHOD OF MANUFACTURING SUCH DISPENSER

(75) Inventors: Frédéric Duquet, Thibouville (FR); Fabrice Perignon, Verneuil (FR)

(73) Assignee: Valois S.A.S., Neubourg (FR)

( * ) Notice: Subject to any disclaimer, the term of this patent is extended or adjusted under 35 U.S.C. 154(b) by 1183 days.

(21) Appl. No.: 11/790,169

(22) Filed: Apr. 24, 2007

(65) Prior Publication Data

US 2007/0263947 A1 Nov. 15, 2007

Related U.S. Application Data

(60) Provisional application No. 60/833,279, filed on Jul. 26, 2006.

(30) Foreign Application Priority Data

Apr. 25, 2006 (FR) ..... 06 51450

(51) Int. Cl.
*B65D 43/16* (2006.01)
*B65D 51/18* (2006.01)
*B65D 51/20* (2006.01)

(52) U.S. Cl. ..... 220/254.3; 220/258.4; 220/259.1; 220/266

(58) Field of Classification Search ..... 220/254.3, 220/258.4, 259.1, 266; 383/66, 203, 96; 221/35, 46; 215/235, 237
See application file for complete search history.

(56) References Cited

U.S. PATENT DOCUMENTS

| | | | | |
|---|---|---|---|---|
| 3,783,920 | A | 1/1974 | Weikert | |
| 4,988,012 | A * | 1/1991 | Shastal | 220/258.4 |
| 5,101,999 | A * | 4/1992 | Robichaud et al. | 220/258.4 |
| 5,145,088 | A * | 9/1992 | Goujon | 220/837 |
| 6,332,552 | B1 * | 12/2001 | Iwasaki et al. | 220/276 |
| 7,387,220 | B2 * | 6/2008 | Verespej et al. | 222/153.01 |
| 7,556,162 | B2 * | 7/2009 | Myhre | 215/235 |
| 2002/0175137 | A1 * | 11/2002 | Rousselet | 215/235 |
| 2003/0159403 | A1 * | 8/2003 | Verespej et al. | 53/412 |
| 2005/0207680 | A1 * | 9/2005 | Schumacher et al. | 383/66 |
| 2006/0043113 | A1 | 3/2006 | Verespej | |

FOREIGN PATENT DOCUMENTS

| | | |
|---|---|---|
| DE | 93 17 973.1 U1 | 6/1994 |
| FR | 1 088 767 | 3/1955 |
| JP | 11-11493 A | 1/1999 |

* cited by examiner

*Primary Examiner* — Anthony Stashick
*Assistant Examiner* — Niki Eloshway
(74) *Attorney, Agent, or Firm* — Sughrue Mion, PLLC

(57) ABSTRACT

A stopper member (C) for mounting on an opening (31) of a fluid reservoir (P), said member being characterized in that it comprises:

a base body (1) forming a fluid dispenser orifice (17);

an assembly part (20) for mounting in stationary manner on the base body (1); and a closure lid (25) for closing the dispenser orifice (17), the lid (25) being connected to the assembly part via a hinge (26), characterized in that the lid (25) and the part (20) are made as a single piece, the lid (25) initially being connected to the assembly part (20), before the lid is opened for the first time, via at least one bridge (28) of material able to be broken at the first opening.

13 Claims, 2 Drawing Sheets

STOPPER MEMBER, A FLUID DISPENSER COMPRISING SUCH A MEMBER, AND A METHOD OF MANUFACTURING SUCH DISPENSER

CROSS REFERENCE TO RELATED APPLICATION

This application claims the benefit under 35 U.S.C. §119 (e) of pending U.S. provisional patent application Ser. No. 60/833,279, filed Jul. 26, 2006, and priority under 35 U.S.C.§119(a)-(d) of French patent application No. FR-06.51450, filed Apr. 25, 2006.

TECHNICAL FIELD

The present invention relates to a stopper member for mounting on an opening of a fluid reservoir, in such a manner as to constitute a fluid dispenser. In addition, the present application also relates to a fluid dispenser and to a method of manufacturing such a dispenser. Various stopper members are used on all types of dispenser in numerous fields, and in particular in the fields of perfumery, cosmetics, or even pharmacy.

BACKGROUND OF THE INVENTION

The first function of a stopper member is to enable fluid stored in the reservoir on which the stopper member is mounted to be dispensed selectively.

The stopper member of the present invention forms a stopper member of the kind that can be qualified as "inert", in that it incorporates neither a pump nor a valve. In other words, the fluid is not put under pressure in an inner chamber formed by the stopper member. The stopper member of the present invention is rather similar to a conventional closure device comprising a dispenser orifice that can be closed by means of a stopper.

However, an inherent problem with "inert" closure devices resides in the fact that it is difficult to assure the user that the stopper member has never been opened in order to dispense fluid. The user who purchases a fluid dispenser wants to be assured that the dispenser has never been used beforehand. In order to mitigate that problem, there already exist in the prior art numerous first-use guarantee systems that are associated with the stopper member. For example, it is possible to envelop the stopper member in a film that must be torn on first use in order to be able to access the stopper member. Screw-on stopper members can incorporate a first-use guarantee strip that prevents the plug from being unscrewed. During first use, the user pulls off the strip, or forces the stopper open, thereby destroying the strip. The stopper member of the present invention is not of the screw-on type, and such a pull-off or destroyable peripheral strip is not appropriate for the present invention.

BRIEF SUMMARY OF THE INVENTION

The present invention thus proposes a stopper member for mounting on an opening of a fluid reservoir, said member being characterized in that it comprises:

- a base body forming a fluid dispenser orifice;
- an assembly part for mounting in stationary manner on the base body; and
- a closure lid for closing the dispenser orifice, the lid being connected to the assembly part via a hinge, characterized in that the lid and the part are made as a single piece, the lid initially being connected to the assembly part, before the lid is opened for the first time, via at least one bridge (28) of material able to be broken at the first opening. It is thus possible to fit the assembly part on the base body, with the closure lid connected to the assembly part. The assembly part fulfills a function of being an intermediate or connection part between the closure lid and the base body. Without the assembly part, it would not be possible to make bridges of breakable material that hold the closure lid in its closed position before it is used for the first time. Once the bridges are broken, the lid can be closed and opened several times without degrading the hinge: the lid is therefore repositionable.

According to another interesting feature of the invention, the lid is enclosed within the assembly part. The assembly part may have the shape of a ring defining an inner space defined by the inner periphery of the ring and its height: the lid does not project upwardly out of this inner space. This provides a particularly flat design to the stopper member. Advantageously, said at least one bridge extends radially outwardly from the outer periphery of the lid and connects the assembly part.

According to another aspect, the lid is spaced from the assembly part by annular slot segments. The slot segments radially surround the lid.

Advantageously, the lid forms a closure pin engaged in leaktight manner in the dispenser orifice of the base body. Only the closure pin projects downwardly out of the inner space of the assembly part.

According to an advantageous characteristic of the invention, the body, the part, and the lid are made as a single piece, the part being connected to the body via a hinge, the part being fitted and fastened on the body. The hinge that serves as a connection between the body and the part can be preserved once the stopper member is assembled, or, on the contrary, it can be removed. In a variant, it is naturally possible to mold the body separately from a molding incorporating the assembly part and the closure lid. Then, the two parts are brought together, so as to constitute the stopper member in its closed position.

In another aspect of the invention, the assembly part defines a substantially plane sealing zone for coming into leaktight contact with the opening of the reservoir. In addition, or in a variant, the body defines a substantially plane sealing zone for coming into leaktight contact with the opening of the reservoir. Thus, the opening of the reservoir can be sealed, and advantageously heat-sealed, either onto the assembly part, or onto the body, or even between the assembly part and the body. The sealing zone is substantially plane or completely plane, in such a manner as to make it possible to heat-seal thereon a flexible sheet presenting an opening defined by a plane peripheral edge. In this way, it is possible to use the stopper member of the invention with a fluid reservoir that can be in the form of a flexible pouch made from one or two flexible sheets, with one of the two flexible sheets forming an opening having a plane edge that is heat-sealed onto the sealing zone of the assembly part and/or of the body. It is thus possible to make a fluid dispenser that is constituted solely by a flexible pouch that is sealed over its periphery, and by a stopper member mounted on an opening formed on one of the faces of the pouch. Such a dispenser can present thickness that is very small, lying in the range about 3 millimeters (mm) to 5 mm, or less. The thickness of the dispenser is constituted essentially by the thickness of the stopper member, given that the flexible sheets present insignificant thickness. Consequently, it is possible to use such a flat dispenser as a fluid sample that can be inserted in magazine publications.

According to another characteristic of the invention, the part defines a continuous and closed peripheral contact zone for coming into leaktight contact with the body. The assembly part can present an annular configuration that forms a closed loop, and the closure lid is situated inside the annular part, being connected to the part via a hinge, and via one or two bridges of breakable material. The annular part can thus be fastened on the base body in leaktight manner, e.g. by adhesive or by heat-sealing. The leaktight contact can extend over the entire periphery of the part and of the body, such that the fluid cannot escape between the base body and the assembly part. A suitable heat-sealing technique is a heat-sealing technique using ultrasound.

The present invention also defines a fluid dispenser having a reservoir of variable volume that comprises at least one flexible sheet defining an opening in which the stopper member is mounted. The reservoir is preferably formed by a pouch constituted by one or two flexible sheets. In a variant, the reservoir can also be formed from a flexible sheet and from another element, such as a thermoformed shell, for example. In addition, it is not impossible for the stopper member to be mounted on the thermoformed shell, thereby forming an opening for receiving the stopper member. The opening is advantageously defined by a plane peripheral edge that is sealed in leaktight manner onto the part and/or onto the body. The plane peripheral edge can be formed by the flexible sheet or even by the thermoformed shell. It should be clearly understood that the opening is made in one sheet, and not between the edges of two bonded-together sheets, as is generally the situation with prior-art pouches.

In another aspect of the invention, the sheet defines an inside for coming into contact with the fluid, and an outside, the stopper member being sealed onto the inside of the sheet. The operation of sealing the stopper member is advantageously performed before the flexible sheet constitutes the fluid reservoir. In other words, when the fluid reservoir is made from a single sheet that is folded in half, the stopper member is sealed onto the sheet before said sheet is folded.

The present invention also provides a method of manufacturing a fluid dispenser comprising a single heat-sealing step during which the part is heat-sealed onto the body, and the sheet is heat-sealed onto the stopper member. Both seals are thus made simultaneously by means of a single heat-sealing unit that can be a unit for heat-sealing by ultrasound, for example.

BRIEF DESCRIPTION OF THE DRAWINGS

The invention is described more fully below with reference to the accompanying drawings which show an embodiment of the invention by way of non-limiting example.

In the figures.

DETAILED DESCRIPTION

Figure 2:
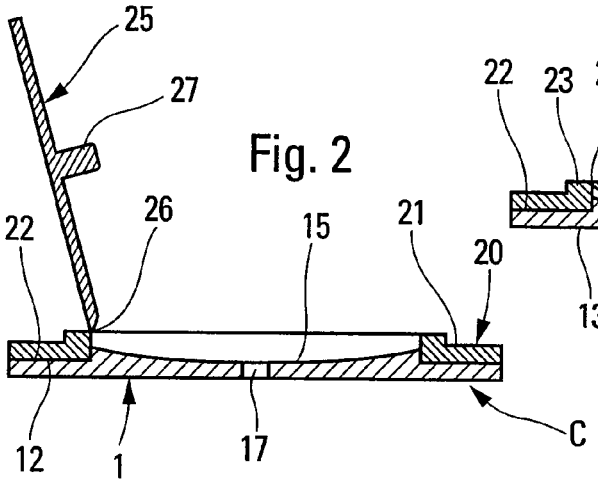
FIG. 2 is a view similar to the view in FIG. 1 showing the stopper member in its open state.

The structure and the functioning of a stopper member constituting a non-limiting embodiment of the invention are described in detail below. Integrating this, or some other, stopper member in a dispenser of the present invention is described thereafter.

The stopper member shown in FIGS. 1 to 6 is designated overall by the letter C. It essentially comprises three component elements, namely a base body 1, an assembly part 20, and a lid 25. The assembly part 20 and the lid 25 can be made as a single piece so as to form only a single molding 2. The lid 25 can be connected to the assembly part 20 via a hinge 26 that can be in the form of a bridge of flexible material.

In this embodiment, the base body 1 is in the form of a washer or of a disk comprising a central area 14 surrounded by a peripheral annular edge 11. The area 14 and the edge 11 define a common bottom surface 13. In addition, the edge 11 defines a top surface 12 that is preferably substantially or completely plane and annular. At its outer periphery, the central area 14 projects from the top surface 12 of the peripheral edge 11. The area 14 thus defines a projecting rim 16 that is annular in shape. The top surface of the central area 14 forms a concave dish 15 that is pierced at its center by a dispenser orifice 17 that passes right through the central area 14, so as to open out to the bottom surface 13. The dish 15 serves as a fluid collection receptacle.

The base body 1 is preferably made by injection-molding a plastics material. In this embodiment, it presents a shape that is annular or circular: however, other geometrical shapes can be envisaged, such as polygonal or oblong shapes, for example. In this embodiment, the bottom surface 13 of the base body is completely plane: however, it is possible to imagine that the surface 13 is made with arbitrary, or specific, profiles that encourage fluid to flow towards the dispenser orifice 17.

In this non-limiting embodiment, the assembly part 20 is in the form of a ring that is preferably complete and closed. However, it is possible to imagine assembly parts that are partially annular or even polygonal in shape. Whatever the configuration, it is necessary for the assembly part to be adaptable on the base body. In this embodiment, the annular assembly part 20 includes an annular peripheral contact zone 22 defined by the bottom surface of the assembly part. On its other side, the assembly part forms a projecting annular bead 23 at the inner periphery of the part. Radially outwards from the bead 23, the top surface of the assembly part 20 forms a plane sealing zone that is substantially or completely annular in shape. The sealing zone 21 serves as a fastener surface for fastening the flexible sheet constituting the flexible pouch of the dispenser of the invention, as described below.

Figure 3:
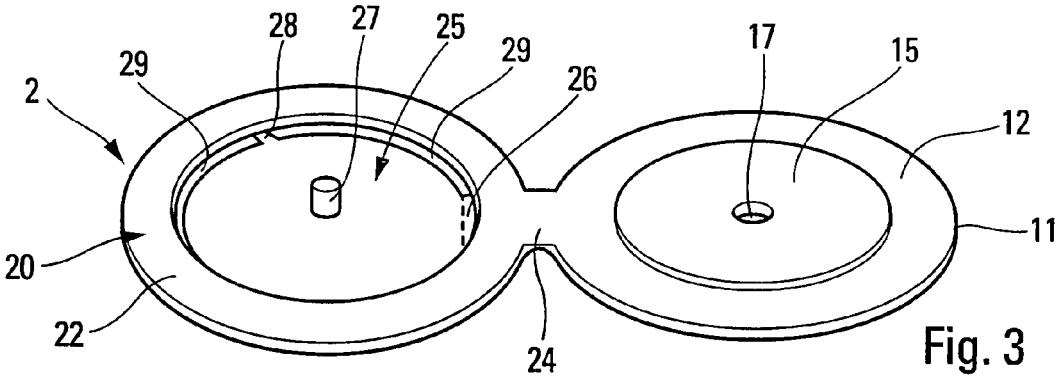
FIG. 3 is a perspective view of a stopper member made as a single piece, shown in its state on being unmolded.
Figure 4:
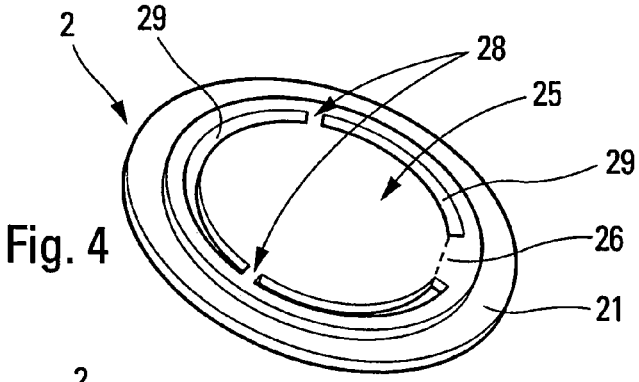
FIGS. 4 and 5 are perspective views, respectively from above and from below, of a portion of a stopper member made in two parts.
Figure 5:
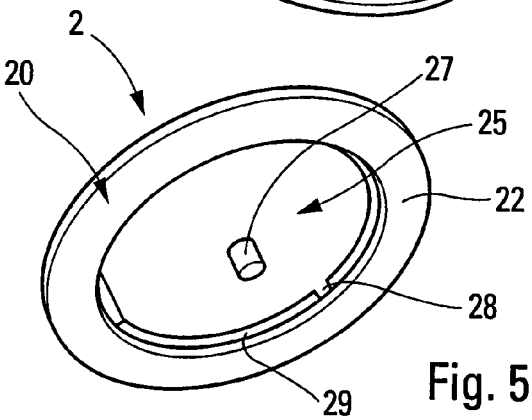

The lid 25 is advantageously made integrally with the assembly part 20, and also presents a disk or washer shape that is disposed inside the assembly part 20, as can be seen in the figures. The lid 25 is connected to the inner periphery of the assembly part, and more precisely to the projecting bead 23, via a flexible hinge 26, and also via one or more bridges 28 of material, as can be seen in FIGS. 3, 4, and 5. The top surface of the lid 25 can be situated in the same plane as the top of the projecting bead 23. The outer peripheral edge of the lid 25 is thus separated from the projecting bead 23 by annular slot segments 29 that are separated by the bridges 28 of material and by the flexible hinge 26. At its center, the lid 25 defines a closure pin 27 that extends from the bottom surface of the lid. Except the pin, the lid is entirely enclosed in the assembly part. The pin could also be off-center, providing the dispenser orifice 17 is also off-center.

Figure 1:
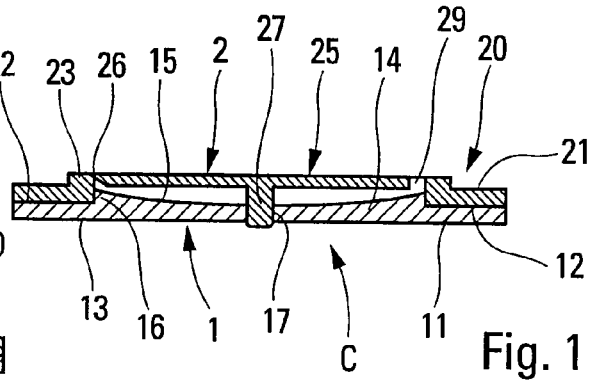
FIG. 1 is a vertical section view through a stopper member of the invention in its closed state.

In the assembled state, as shown in FIGS. 1 and 2, the assembly part 20 is fitted on the base body 1 such that the contact zone 22 of the assembly part 20 comes into contact with the top surface 12 of the peripheral edge 11 of the base body 1. Contact between the zone 22 and the surface 12 is advantageously leaktight over the entire periphery. This leaktight contact can be achieved by any suitable means, such as by leaktight clamping, leaktight snap-fastening, adhesive, or heat-sealing, for example. A technique of heat-sealing by ultrasound is particularly well suited. It should be observed in FIGS. 1 and 2 that the assembly part 20 comes to be housed tightly around the projecting rim 16 formed by the central area 14. The outside diameter of the assembly part 20 is advantageously identical to the outside diameter of the base body 1. Once the assembly part 20 is fitted in this way on the base body 1, the lid 25 can pivot about the hinge 26 between an open position, as shown in FIG. 2, and a closed position, as shown in FIG. 1, in which the closure pin 27 is engaged in leaktight manner in the dispenser orifice 17 of the base body 1. The lid can be opened and closed as desired, without breaking the hinge 26.

However, when the stopper member C has just been assembled, as shown in FIG. 1, the lid 25 is connected to the assembly part 20 not only via the flexible hinge 26, but also via the bridges 28 of material that are thus still intact. This is the configuration of the stopper member C before the lid is used or opened for the first time. In this initial configuration, the integrity of the bridges 28 of material gives the user or the purchaser an infallible visual indication that the stopper member has never been opened. In other words, the bridges 28 of material fulfill a function of guaranteeing to the user the absence of any previous use.

Figure 6:
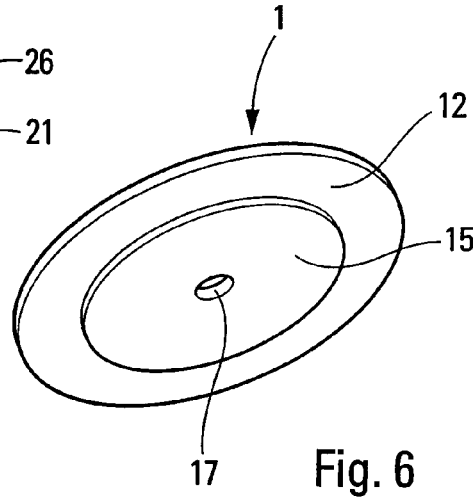
FIG. 6 is a perspective view from below of a portion of a stopper member for associating with the portion shown in FIGS. 4 and 5.

It should be noted that such a stopper member C is made of three distinct parts only, namely a body 1, an assembly part 20, and a lid 25, even if the parts can be made as a single piece. Because of the techniques used in molding, it is not possible to connect the lid 25 directly to the base body 1 via a flexible hinge 26 and bridges 28 of breakable material. This particular configuration is made possible by the use of an intermediate assembly part 20 that forms the connection between the base body 1 and the lid 25. The assembly part 20 can be made integrally with the lid 25 by being connected together via the flexible hinge 26 and the bridges 28 of breakable material. The assembly part 20 is then fitted and fastened into place on the assembly body 1, preferably in leaktight manner. The base body 1, and the molding 2 formed by the assembly part 20 and the lid 25, can be made in two pieces, as shown in FIGS. 4, 5, and 6, or, in a variant, the body 1 and the molding 2 can be made as a single piece by being connected via a hinge 24, as shown in FIG. 3. The two parts can thus be fitted one on the other by deforming the hinge 24.

It should also be observed that the stopper member C of the present invention presents thickness that is very small, lying in the range about 2 mm to 5 mm. This is made possible by the fact that the assembly part 20 is engaged a little inside the base body 1 (around the rim 16), and by the fact that the lid 25 is disposed inside the assembly part 20, without projecting upwards therefrom. The thickness of the stopper member C thus corresponds substantially to the height of the closure pin 27 of the lid 25.

Figure 7:
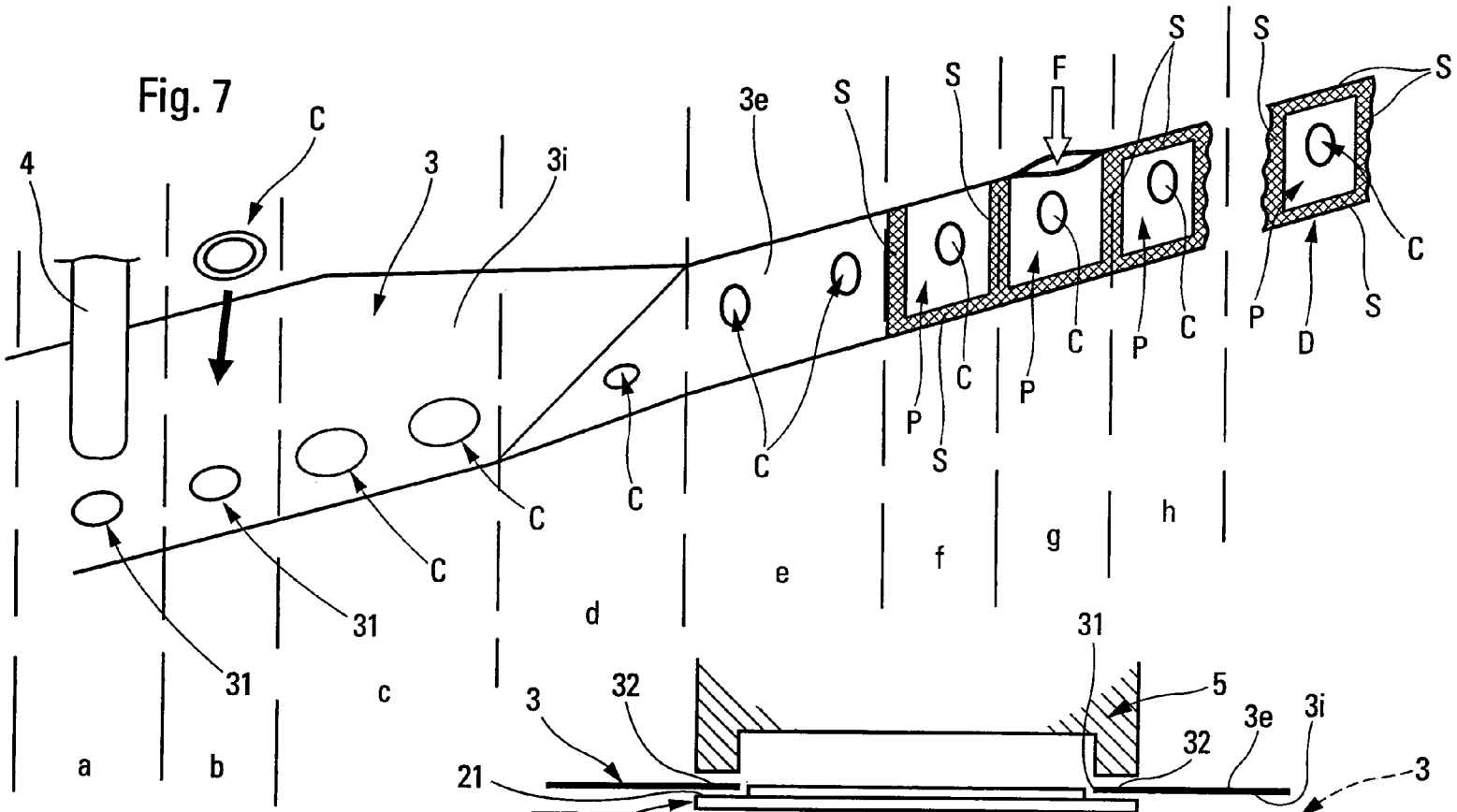
FIG. 7 is a diagrammatic view for demonstrating the method of manufacturing a fluid dispenser that is capable of integrating a stopper member of FIGS. 1 to 6.
Figure 8:
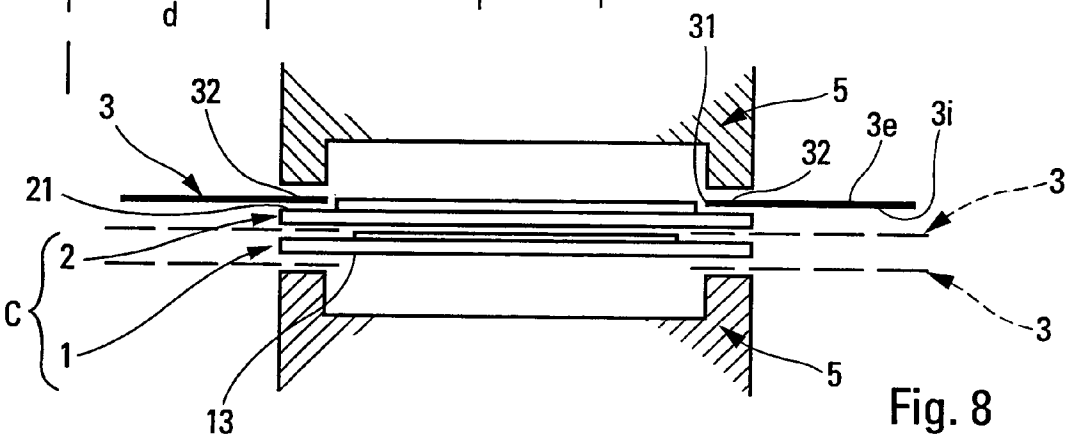
FIG. 8 is a diagrammatic section view for demonstrating the single heat-sealing operation that makes it possible simultaneously to seal a stopper member onto a sheet, and to assemble said same stopper member.

Reference is made below to FIGS. 7 and 8 in order to describe in detail an advantageous method of manufacturing a fluid dispenser that is capable of integrating a stopper member C such as described with reference to FIGS. 1 to 6. The fluid dispenser described above can also integrate some other type of stopper member. However, in the description below, it is assumed that the stopper member used in FIGS. 7 and 8 is the stopper member in FIGS. 1 to 6.

FIG. 7 is a view that shows in very diagrammatic manner the various manufacturing steps a, b, c, d, e, f, g, and h that are implemented in a method of manufacturing a fluid dispenser of the invention. The manufacturing method uses, as a first material, a continuous strip of flexible sheet 3 and stopper members C. In order to work the first material, the manufacturing method of the invention also uses tools, such as a punch 4, or a heat-sealing unit (FIG. 8), for example.

The strip of flexible sheet 3 is initially plane, and can be unrolled from a roll. The sheet 3 thus presents a determined width. When looking at FIG. 7, it can be seen that the sheet 3 is completely plane in steps a and b, in the process of being folded in steps c and d, and folded fully in half in steps e, f, g, and h. The manufacturing method of the invention progresses from left to right in FIG. 7, starting with step a. Thus, once the strip of flexible sheet 3 is unrolled from its roll, it extends until it reaches a first punching or cutting station where the sheet is cut by means of a punching tool 4 in such a manner as to form an opening 31, which, in this embodiment, is circular in shape. It should be noted that this punching operation is performed while the sheet 3 is plane, i.e. exempt from any folds. The edge 32 of the opening is therefore substantially or completely plane and surrounds the opening.

In the second step b, the sheet 3 is still plane, and the stopper member C can then be mounted in the opening 31 of the sheet 3.

Once the stopper member C is in place on the still-plane sheet 3, the stopper member C can then, in step c, be fastened in the opening 31, e.g. by means of a heat-sealing technique, e.g. by ultrasound. It should be noted that the stopper member C is put into place on the sheet 3 with its lid facing downwards, and its bottom surface 13 facing upwards.

During step d, the sheet 3 is folded in half, such that the other face of the stopper member C is visible.

At step e, the folding operation is terminated: the sheet 3 is thus folded in half, forming two panels that are connected together via the bottom edge.

During step f, the folded sheet is heat-sealed on two or three sides, given that the heat-sealing of the bottom edge is optional, since the sheet 3 is continuous along this edge. The seals S result in the two panels formed by the folded sheet 3 being bonded together. As a result, a small pouch P is obtained, defined by at least two vertical, side seals S, and a bottom edge that is optionally heat-sealed. The stopper member C is situated on one of the two panels of the folded sheet, remote from the seals S.

During step g, the pouch P is filled with fluid F via the side of the pouch P that has still not been heat-sealed. To do this, it suffices to half open the pouch P in such a manner as to create an opening.

Then, step h consists in finishing off the heat-sealing of the pouch P, along the side via which filling with fluid F was performed in step g. The fluid F contained in the pouch P is thus isolated from the outside by the peripheral seals S. Its only possible exit is via the stopper member C that is still closed.

The last manufacturing step consists in detaching each pouch P, in such a manner as to define a respective fluid dispenser D.

It should be noted in the manufacturing method that the stopper member C is mounted on the flexible sheet 3 before the pouch P is formed, and even before the flexible sheet is folded. The stopper member C is mounted on the sheet 3 while said sheet is still flat, i.e. while it does not have any folds serving to make a pouch.

It should also be observed that the stopper member C is mounted on the inside, i.e. on the inside 3*i* of the sheet 3, which inside then forms the inside walls of the pouch.

This technique of fastening the stopper member on the sheet 3 while said sheet is still flat, and moreover on the side 3*i* forming the inside of the pouch, makes the method of manufacturing the fluid dispenser considerably easier. It is much easier to mount a stopper member on a plane sheet than on the inside of a pouch that has already been formed and filled with fluid.

FIG. 8 shows in greater detail the implementation of step c during which the stopper member C is mounted in the opening 31 of the flexible sheet 3. This step uses a heat-sealing unit that is represented diagrammatically by the two jaws 5 in FIG. 8. By way of example, the jaws could be the jaws of a unit for heat-sealing by ultrasound, comprising an anvil and a sonotrode. FIG. 8 also shows a detail of the stopper member C, which is the stopper member in FIGS. 1 to 6. It is possible to identify the base body 1, and the molding 2 incorporating the assembly part 20 and the lid 25. In a preferred embodiment, the edge 32 of the opening 31 is heat-sealed onto the outer periphery of the assembly part 20 at the sealing zone 21. In reality, the figure is drawn the opposite way up to step c shown in FIG. 7. Whereas the sheet 3 is shown in step c in FIG. 7 from the inside 3*i*, then forming the inside of the pouch P, the sheet 3 in FIG. 8 is shown with its inside facing downwards and its outside 3e facing upwards. Once the sheet 3 is folded in half, the base body 1 is situated inside the pouch, only the lid 25 and the projecting bead 23 being visible through the opening 31 of the sheet.

In a variant, it is also possible to heat-seal the edge 32 of the opening of the sheet 3 onto the underside of the base body 1, i.e. against the bottom surface 13, or even between the base body 1 and the molding 2. This is shown in FIG. 8 with the sheet 3 being shown by dashed lines. By way of example, it is possible to use the sheet 3 as a connection or heat-sealing interface between the base body 1 and the molding 2.

According to another advantageous characteristic of the invention, the molding 2 incorporating the assembly part 20 and the lid 25 is fastened on the base body 1 at the same time as the sheet 3 is fastened on the stopper member C. In an advantageous embodiment, the heat-sealing unit 5 simultaneously heat-seals the sheet 3 onto the stopper member C, and the molding 2 onto the base body 1. Two distinct seals are thus made during a single operation by means of a single heat-sealing unit.

The above-described manufacturing method advantageously, but not exclusively, uses a stopper member C as described and shown in FIGS. 1 to 6. However, it is possible to use some other type of stopper member in the manufacturing method of the invention.

The flexible sheet 3 can be made from any suitable material, and it can be in the form of a metal or plastics composite film, for example. The flexible sheet 3 should make it possible to manufacture a pouch P that has little or no shape memory. In other words, when the pouch P is deformed, it remains in its deformed state.

By means of the characteristics of the invention, it is possible to manufacture easily and at low cost a fluid dispenser D having a stopper member that is put into place before the pouch is formed. In addition, the stopper member can advantageously integrate first-use safety means, but without complicating its molding or its assembly. At the end, a dispenser D is obtained that presents a minimum thickness that corresponds substantially to the thickness of the stopper member that is about 2 to 5 mm. As a result, it is possible to insert the dispenser D in magazines by way of an advertising sample.

The invention claimed is:

1. A stopper member (C) for mounting on an opening (31) of a fluid reservoir (P), said member being characterized in that it comprises:

a base body (1) forming a fluid dispenser orifice (17);

an assembly part (20) for mounting in stationary manner on the base body (1); and a closure lid (25) for closing the dispenser orifice (17), the lid (25) being connected to the assembly part via a hinge (26), the lid (25) and the part (20) being made as a single piece, the lid (25) initially being connected to the assembly part (20), before the lid is opened for the first time, via at least one bridge (28) of material able to be broken at the first opening, the closure lid engaging the dispenser orifice (17) in leaktight manner, in which the body (1), the part (20), and the lid (25) are made as a single piece, the part (20) being connected to the body (1) via a hinge (24), the part (20) being fitted and fastened on the body (1).

2. A stopper member according to claim 1, in which the lid (25) is enclosed within the assembly part.

3. A stopper member according to claim 1, in which said at least one bridge (28) extends radially outwardly from the outer periphery of the lid and connects the assembly part (20).

4. A stopper member according to claim 1, in which the lid (25) is spaced from the assembly part (20) by annular slot segments (29).

5. A stopper member according to claim 1, in which the lid (25) forms a closure pin (27) engaged in leaktight manner in the dispenser orifice (17) of the base body (1).

6. A stopper member according to claim 1, in which the body (1) defines a substantially plane sealing zone (12; 13) for coming into leaktight contact with the opening (31) of the reservoir.

7. A stopper member according to claim 1, in which the part (20) defines a continuous and closed peripheral contact zone (22) for coming into leaktight contact with the body (1).

8. A fluid dispenser (D) including a stopper member (C) according to claim 1, comprising:

a fluid reservoir (P) of variable volume that comprises at least one flexible sheet (3) defining an opening (31); and wherein the stopper member (C) is mounted in the opening (31) of the sheet (3).

9. A fluid dispenser according to claim 8, in which the opening (31) is defined by a plane peripheral edge (32) that is sealed in leaktight manner onto the part (20) and/or onto the body (1).

10. A fluid dispenser according to claim 9, in which the sheet (3) defines an inside for coming into contact with the fluid, and an outside, the stopper member (C) being sealed onto the inside of the sheet.

11. A fluid dispenser according to claim 8, in which the stopper member presents thickness that is less than 5 mm, and that is advantageously less than or equal to 3 mm, such that the dispenser is very flat.

12. A method of manufacturing a dispenser according to claim 8, comprising a single heat-sealing step during which the part (20) is heat-sealed onto the body (1), and the sheet (3) is heat-sealed onto the stopper member (C).

13. A stopper member (C) for mounting on an opening (31) of a fluid reservoir (P), said member being characterized in that it comprises:

a base body (1) forming a fluid dispenser orifice (17);

an assembly part (20) for mounting in stationary manner on the base body (1); and a closure lid (25) for closing the dispenser orifice (17), the lid (25) being connected to the assembly part via a hinge (26), the lid (25) and the part (20) being made as a single piece, the lid (25) initially being connected to the assembly part (20), before the lid is opened for the first time, via at least one bridge (28) of material able to be broken at the first opening, the closure lid engaging the dispenser orifice (17) in leaktight manner, in which the assembly part (20) defines a substantially plane sealing zone (21; 22) for coming into leaktight contact with the opening (31) of the reservoir.

* * * * *